United States Patent [19]

Grover

[11] Patent Number: 4,817,837

[45] Date of Patent: Apr. 4, 1989

[54] STRAP FOR HOLDING SKIS AND SKI POLES

[76] Inventor: Betty L. Grover, P.O. Box 58, Ashton, Id. 83420

[21] Appl. No.: 92,668

[22] Filed: Sep. 3, 1987

[51] Int. Cl.[4] ..... A45F 3/14; B65D 63/10

[52] U.S. Cl. ..... 224/250; 24/16 PB; 224/917

[58] Field of Search ..... 224/202, 917, 250, 257; 280/814; 24/16 R, 16 PB, 17

[56] References Cited

U.S. PATENT DOCUMENTS

| | | | |
|---|---|---|---|
| 1,945,932 | 2/1934 | Caley | 24/16 PB |
| 2,530,695 | 11/1950 | Helmert | 224/917 X |
| 2,961,785 | 11/1960 | Toepfer | 24/16 PB X |
| 3,224,054 | 12/1965 | Lige | 24/16 PB |
| 3,275,205 | 9/1966 | Howd . | |
| 3,365,753 | 1/1968 | Prenner et al. | 24/16 PB |
| 3,702,203 | 11/1972 | Oltmanns . | |
| 3,731,348 | 5/1973 | Luehne . | |
| 3,768,711 | 10/1973 | Wilkinson . | |
| 3,913,179 | 10/1975 | Rhee | 24/16 PB |
| 3,920,166 | 11/1975 | Hogensen, Jr. . | |
| 3,960,302 | 6/1976 | Mazzoni, Jr. | 224/917 X |
| 3,976,234 | 8/1976 | Moudry . | |
| 3,997,943 | 12/1976 | Jones et al. | 24/16 PB X |
| 4,150,463 | 4/1979 | Brown | 24/16 PB |
| 4,466,159 | 8/1984 | Burrage . | |
| 4,470,528 | 9/1984 | Dyess | 224/917 X |
| 4,518,107 | 5/1985 | Amos . | |
| 4,531,661 | 7/1985 | Santy . | |

FOREIGN PATENT DOCUMENTS

| | | | |
|---|---|---|---|
| 2571625 | 4/1986 | France | 224/917 |

*Primary Examiner*—Werner H. Schroeder

*Attorney, Agent, or Firm*—Fleit, Jacobson, Cohn & Price

[57] ABSTRACT

A double loop strap for securing a pair of skis in assembled back-to-back relation in an inner loop and a pair of ski poles in parallel relation to the skis in an outer loop with the strap being in the form of an elongated member of uniform width and thickness provided with tapered ends and two pairs of sid edge notches with the notches in each pair being laterally aligned with each other and being of generally V-shaped configuration. The strap includes a pair of elongated slots defined by spaced parallel side edges with the slots and notches being staggered in relation so that the adjacent pair of notches and slot can be connected together and the remote pair of notches and slot can be connected to each other by twisting the strap and inserting an end thereof through the slot until the pair of notches is registered therewith so that the strap can then be untwisted and lie in a generally flat condition.

2 Claims, 1 Drawing Sheet

STRAP FOR HOLDING SKIS AND SKI POLES

BACKGROUND OF THE INVENTION

1. Field of Invention

This invention relates to holders for skis and ski poles and is particularly concerned with holders formed from straps that encircle skis and ski poles in a unique manner by being looped through elongated slots of a predetermined length to secure the narrow cross country skis and poles and hold them in an assembled compact condition.

2. Description of Related Art

The need for holders for skis and ski poles that will hold them in an assembled and compact condition for use, storage and transportation and the like has long been recognized. For the daily user it is important that the holder be quick and easy to use and store.

U.S. Pat. No. 3,731,348 issued to Luehne discloses a ski tying strap using a hook and loop type fastening means such "Velcro" to hold only the skis together. Unfortunately, this is not for use with holding both the skis and the ski poles.

Various devices are known in the art for holding skis and ski poles, but they are either too cumbersome, too expensive to manufacture, or too difficult to store. U.S. Pat. No. 3,976,234 issued to Moudry et al discloses a device for holding skis and ski poles together comprised of an elastic strap with a metal C-shaped clip at one end and a locking mechanism at the other. Ski poles are held by the C-shaped clips which are of a fixed size. Since different ski poles may vary slightly in diameter, the clips do not allow for easy interchangeability of pairs of ski poles with pairs of skis.

U.S. Pat. No. 3,960,302 issued to Mazzoni, Jr. discloses a ski and ski pole carrying device which is equipped to be carried over the shoulder. U.S. Pat. Nos. 2,530,695 and 3,920,166 issued to Helmert and Hogensen, Jr., respectively, disclose ski and ski pole carrying devices which are equipped to be carried either over the shoulder or around the waist. U.S. Pat. No. 3,768,711 issued to Wilkinson discloses an adjustable strap for carrying skis and ski poles with a hand held strap. All of these devices are much more cumbersome to store than the present invention for the everyday skier.

A variety of adjustable straps are well-known in the prior art. U.S. Pat. No. 4,531,661 issued to Santy discloses a ski and ski pole holder comprised of a pair of straps sewn together in back-to-back fashion and having connected rings for adjusting the hold on the skis. U.S. Pat. No. 4,466,159 issued to Burrage discloses an adjustable plastic tie strap operable from either end for securing furled sails, bundles, closed bags and sacks and like combinations with a series of spaced rectangular openings to secure the objects together. This plastic tie does not double loop like the present invention and is not directed to the art of holding skis and ski poles.

Accordingly, a primary purpose of the present invention is to provide an easy, simple transport system for skis and ski poles that can also be utilized as a compact storage unit and is inexpensive and simple to manufacture.

SUMMARY OF THE INVENTION

In general, a strap device for holding skis and/or ski poles in accordance with the present invention comprises a strap having two rounded ends and a portion of substantially uniform width between the two ends. A pair of notches on opposite edges of the strap is adjacent the first end and forms an insert portion between the first end and the pair of notches. An elongated slot of preselected length in the strap is adjacent the second end. The length is selected to be slightly longer than the distance between the pair of notches. A second pair of notches in the strap is between the elongated slot and the first pair of notches. A second elongated slot of preselected length in the strap is between the two pairs of notches. The length of the second elongated slot is slightly longer than the distance between the second pair of notches. The distance between the second pair of notches and the second elongated slot is slightly longer than the circumferential distance around a pair of skis.

More specifically, the strap device may be made of waterproofed leather.

BRIEF DESCRIPTION OF THE DRAWINGS

The accompanying drawings illustrate complete preferred embodiment of the present invention according to the best mode presently devised for the practical applications of the principles thereof, and in which.

DETAILED DESCRIPTION

Figure 1:
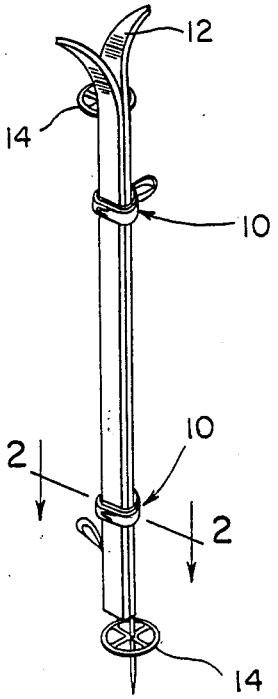
FIG. 1 is a perspective view of skis and ski poles held by a strap.

Referring to FIG. 1 of the drawing, there is illustrated therein a perspective view of two straps 10 holding skis 12 and ski poles 14 in position for easy transport. Each of the straps 10 are located near opposite ends of the ski 12 and ski pole 14 combination. The ski poles 14 may be facing opposite directions as shown in the drawing.

Figure 2:
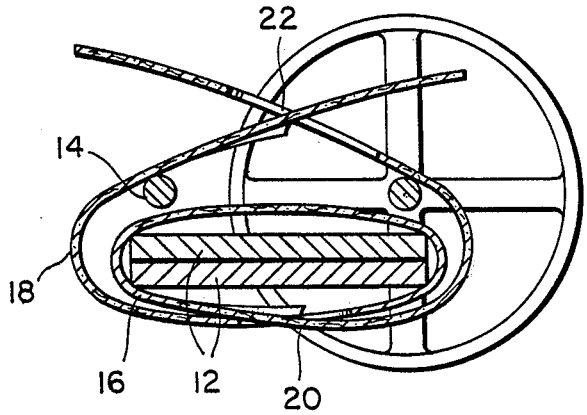
FIG. 2 is a cross sectional view taken of assembly of the skis and poles held by the strap as shown in FIG. 1 taken along line 2—2 on FIG. 1.

Referring to FIG. 2, a cross-sectional view taken along line 2—2 of the assembly shown in FIG. 1 is illustrated. The strap 10 forms an inner loop 16 and an outer loop 18. The inner loop 16 snugly holds the skis 12, while the ski poles 14 are held between the outer loop 18 and the inner loop 16. Two releaseable lock connections 20 and 22 are formed in the strap 10. The inner loop is formed by releaseable lock connection 20 and the outer loop is formed by both releaseable lock connections 20 and 22.

Figure 3:
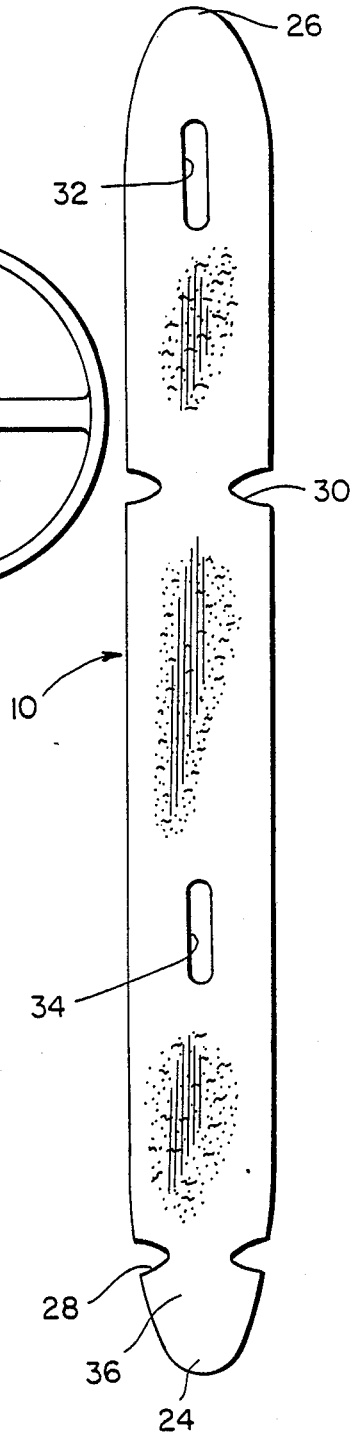
FIG. 3 is a top plan view of one major surface of the strap shown in FIGS. 1 and 2 with the ends of the straps extended.

A top plan view of the strap 10 in an extended position is illustrated in FIG. 3. The strap 10 has two rounded ends 24 and 26 and a portion of substantially uniform width between the two ends. The strap 10 has two pairs of notches 28 and 30 being on opposite edges of the straps and two elongated slots 32 and 34 of preselected length. The length of the elongated slots 32 and 34 are chosen to be slightly longer than the distance between the inner edges of the notches of each corresponding pair of notches 28 and 30.

The first pair of notches 28 is adjacent the first end 24 to form an insert portion between the first end and the first pair of notches. The first elongated slot 34 in the strap is adjacent the second end 26. The second pair of notches 30 is between the first elongated slot 32 and said first pair of notches 28. The second elongated slot 34 in the strap 10 is between the first and second pairs of notches 28 and 30. The distance between the second pair of notches 30 and the second elongated slot 34 is slightly longer than the circumferential distance around a pair of skis.

Figure 4:
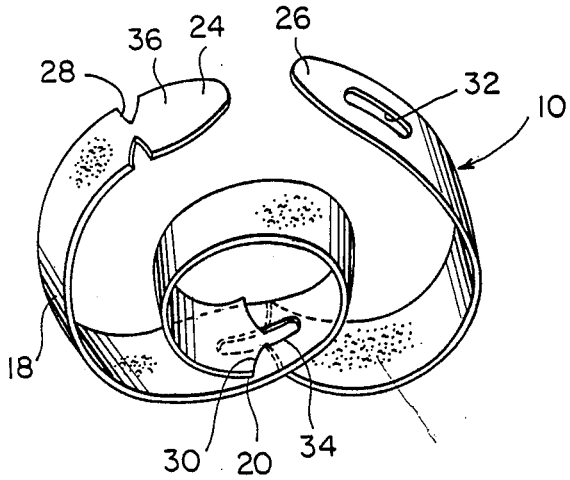
FIG. 4 is a perspective view of the strap shown in FIGS. 1–3 in an intermediate stage of its assembly.

In FIG. 4, a perspective view of the strap 10 in a intermediate stage of assembly is illustrated. The second end 26 is inserted into the second elongated slot 34 until the pair of notches 30 are inserted into the slot to form a releaseable connection 20 and the inner loop 16 as shown in FIG. 4. A cross-sectional view of the fully assembled strap with skis 12 and ski poles 14 is illustrated in FIG. 2. Next, the insert portion 36 near the first end 24 is inserted through the elongated slot 32 until the pair of notches 28 snugly fit inside the slot to form a second releaseable lock connection 22 and the outer loop 18.

The above-mentioned operation should preferably be performed with the skis 12 and ski poles 14. First, the skis 12 should be stood up vertically back-to-back. The strap 10 should be wrapped around the skis 12 near the top and the inner loop 16 should be formed around it. Once the strap 10 is snugly around the skis 12, stand poles 14 at the front of the skis 12 and form the outer loop 18 around the poles with one pole upside down to secure the poles. Then, repeat the operation with a second strap 10 at the bottom of the skis 12.

A preferred embodiment of the strap 10 is made of leather. Preferably the leather is waterproofed to preserve polish and keep it soft.

The foregoing description illustrates preferred embodiments of the invention. However, concepts employed may be based upon such description, and be employed in other embodiments without departing from the scope of the invention. Accordingly, the following claims are intended to protect the invention broadly, as well as in the specific form shown herein.

What is claimed is:

1. A strap device for holding skis and ski poles comprising:

a strap having first and second ends and a portion of substantially uniform width between said first and second ends, a first pair of notches on opposite ends of said strap adjacent said first end to form an insert portion between said first end and said first pair of notches;

a first elongated slot of preselected length in the strap adjacent said second end wherein the preselected length of the first slot is slightly longer than the distance between the inner edges of the first pair of notches;

a second pair of notches in said strap between said first elongated slot and said first pair of notches; and a second elongated slot of preselected length in said strap between said first and second pairs of notches wherein the preselected length of the second slot is slightly longer than the distance between the inner edges of the second pair of notches, each of said slots being defined by spaced parallel edges, the distance between the first slot and first pair of notches being slightly longer than the circumferential distance around a pair of back-to-back skis, the distance between said second pair of notches and second elongated slot being slightly longer than the circumferential distance around a pair of ski poles and that portion of the strap encircling the skis.

2. A double loop strap for retaining a pair of skis in back-to-back assembled relation in an inner loop and a pair of ski poles in generally parallel relation to each other and to the skis in an outer loop, said strap comprising an elongated flexible member of constant width defined by generally parallel side edges and tapering ends to facilitate manipulation, said elongated member having a pair of slots along the center line thereof with the slots being disposed in spaced relation, each slot having spaced parallel side edges and a length slightly less than the width of the elongated member, said elongated member having two pairs of notches in the side edges thereof with the notches in each pair being laterally aligned and of generally V-shaped configuration with the distance between the inner edges of the notches being slightly less than the length of the slots to enable insertion of the strap through a slot when twisted until a pair of notches registers with the slot so that the strap can then be oriented parallel with the portion of the strap having the slot therein so that the engaged pair of notches and slot forms a loop with the strap being substantially flat through the connection, said slots and notches being arranged in alternating relation with the slot and pair of notches oriented closest to each other forming a connection to form an inner loop closely encircling a pair of skis placed in back-to-back relation and the remote slot and pair of notches being connected to form an outer loop with the ski poles positioned between the inner loop and outer loop to secure the ski poles in place when the remote pair of notches and slot are connected by inserting the portion of the strap having the notches through the slot when in twisted position and untwisting the strap when the notches register with the slot so that the connection formed by the slot and notches enables the strap to lay flat.

* * * * *